US009909375B2

(12) United States Patent
Church

(10) Patent No.: US 9,909,375 B2
(45) Date of Patent: Mar. 6, 2018

(54) FLOW CONTROLLER FOR USE IN DRILLING OPERATIONS

(71) Applicant: GROUPE FORDIA INC., Dollard-des-Ormaux (CA)

(72) Inventor: Rusty Church, Olathe, CO (US)

(73) Assignee: GROUPE FORDIA INC., Dollars des Ormeaux (CA)

( * ) Notice: Subject to any disclaimer, the term of this patent is extended or adjusted under 35 U.S.C. 154(b) by 283 days.

(21) Appl. No.: 14/771,960

(22) PCT Filed: Mar. 13, 2014

(86) PCT No.: PCT/IB2014/059762
§ 371 (c)(1),
(2) Date: Sep. 1, 2015

(87) PCT Pub. No.: WO2014/141157
PCT Pub. Date: Sep. 18, 2014

(65) Prior Publication Data

US 2016/0290078 A1 Oct. 6, 2016

Related U.S. Application Data

(60) Provisional application No. 61/785,889, filed on Mar. 14, 2013.

(51) Int. Cl.
*E21B 21/10* (2006.01)
*E21B 34/06* (2006.01)
(Continued)

(52) U.S. Cl.
CPC ..... *E21B 21/10* (2013.01); *E21B 12/00* (2013.01); *E21B 34/06* (2013.01); *E21B 34/08* (2013.01);
(Continued)

(58) Field of Classification Search
CPC ..... E21B 12/00; E21B 21/10; E21B 34/00; E21B 34/06; E21B 34/12; E21B 2034/005
(Continued)

(56) References Cited

U.S. PATENT DOCUMENTS 103,596 A 5/1870 Frisbie
301,230 A 7/1884 Green
(Continued)

OTHER PUBLICATIONS

International search report for PCT application PCT/IB2014/059762 filed Mar. 13, 2014, from which the present application is a national phase entry.
(Continued)

*Primary Examiner* — Frederick L Lagman

(57) ABSTRACT

A system (10) for drilling a borehole (14) in a subterranean formation (16) containing a fluid (18), comprising: an outer tube (24) defining an outer tube distal end (26) configured for attaching a drill bit (12) thereto and a flow controller receiving section (27) spaced apart therefrom; a flow controller (28) including a flow controller body (30) defining body proximal and distal ends (32 and 34) and securable to the outer tube (24) in the flow controller receiving section (27); and a drilling accessory (36) insertable in the outer tube (24) and through the flow controller (28). The flow controller (28) is movable between open and closed configurations. In the open configuration, the flow controller (28) allows passage of the drilling accessory (36) therethrough. In the closed configuration, the flow controller (28) hinders flow of the fluid therethrough towards the borehole proximal end (20) when the flow controller (28) is located closer to the borehole proximal end (20) than the fluid (18).

31 Claims, 2 Drawing Sheets

(51) Int. Cl.

| | |
|---|---|
| ***E21B 34/08*** | (2006.01) |
| ***E21B 12/00*** | (2006.01) |
| ***E21B 47/00*** | (2012.01) |
| ***E21B 49/08*** | (2006.01) |
| *E21B 34/00* | (2006.01) |

(52) U.S. Cl.
CPC ..... *E21B 47/00* (2013.01); *E21B 49/083* (2013.01); *E21B 2034/005* (2013.01)

(58) Field of Classification Search
USPC ..... 166/316, 332.1, 332.8
See application file for complete search history.

(56) References Cited

U.S. PATENT DOCUMENTS

| | | | | |
|---|---|---|---|---|
| 1,871,328 | A | 8/1932 | Kunz | |
| 2,071,700 | A | 2/1937 | McPhail | |
| 2,094,707 | A | 10/1937 | Jones | |
| 2,256,119 | A | 9/1941 | Lillich | |
| 2,503,896 | A | 4/1950 | Yount | |
| 2,572,299 | A | 10/1951 | Antolch | |
| 2,670,757 | A | 3/1954 | Delany | |
| 2,846,178 | A | 8/1958 | Minor | |
| 2,911,997 | A | 11/1959 | Schramm et al. | |
| 2,956,582 | A | 10/1960 | Pranter | |
| 2,976,882 | A | 3/1961 | Cowan | |
| 3,684,013 | A | 8/1972 | Brown | |
| 4,067,540 | A | 1/1978 | Slade | |
| 4,178,638 | A | 12/1979 | Meyer | |
| 4,351,358 | A | 9/1982 | Ogle, Jr. | |
| 4,371,045 | A | 2/1983 | McGuire et al. | |
| 4,465,102 | A | 8/1984 | Rupp | |
| 4,532,995 | A | 8/1985 | Kaufman | |
| 4,858,882 | A | 8/1989 | Beard et al. | |
| 5,044,396 | A | 9/1991 | Daudet et al. | |
| 5,592,966 | A | 1/1997 | Gates | |
| 6,375,155 | B1 | 4/2002 | Janssens | |
| 2006/0016479 | A1 | 1/2006 | Gonzales | |
| 2007/0090320 | A1 | 4/2007 | Makowan et al. | |
| 2007/0095542 | A1* | 5/2007 | Lembcke | E21B 34/08 166/372 |
| 2007/0095545 | A1* | 5/2007 | Lembcke | E21B 34/08 166/386 |
| 2009/0242209 | A1* | 10/2009 | Mondelli | E21B 34/10 166/373 |
| 2009/0255679 | A1* | 10/2009 | Bartette | E21B 25/08 166/319 |
| 2012/0205116 | A1 | 8/2012 | MacRae et al. | |
| 2012/0234607 | A1* | 9/2012 | Kinsella | E21B 25/02 175/403 |

OTHER PUBLICATIONS

Written opinion for PCT application PCT/IB2014/059762 filed Mar. 13, 2014, from which the present application is a national phase entry.

* cited by examiner

FLOW CONTROLLER FOR USE IN DRILLING OPERATIONS

FIELD OF THE INVENTION

This invention relates to the field of drilling. More particularly, the invention relates to a flow controller for use in drilling operations.

BACKGROUND OF THE INVENTION

Some subterranean formations contain fluids, such as water, often at great pressure. When drilling a borehole through such formations, the fluid may flow out of the borehole, which causes safety problems for drilling personnel. These safety problems are increased when the fluid is at relatively high or low temperatures. In addition, in some drilling operations, a borehole is drilled in an upward direction from underground. In these cases, reaching fluids while drilling, which then do not even have to be pressurized, can result in large flows of these fluids in a tunnel from which drilling proceeds. Such flows have to be reduced or stopped rapidly to avoid potential flooding of the tunnel.

The prior art presents some drilling systems that include a valve to help mitigate the problems described hereinabove. However, they are not well adapted to some tasks, such as sample recovering samples from the borehole as the valve does not allow passage of conventional sample recovering accessories therethrough. Also, they are often relatively complex as they include control systems allowing selective operation of the valve between open and closed configurations by an operator.

Against this background, there exists a need in the industry to provide improved systems, devices and method allowing access to a distal end of a borehole even when the borehole is drilled though fluid containing formations.

An object of the present invention is therefore to provide such systems, devices and methods.

SUMMARY OF THE INVENTION

In a broad aspect, the invention provides a system usable with a drill bit for drilling a borehole in a subterranean formation containing a fluid, the borehole defining a borehole proximal end and an opposed borehole distal end, the system comprising: an outer tube, the outer tube defining an outer tube distal end and a flow controller receiving section spaced apart from the outer tube distal end, the outer tube being configured for attaching the drill bit thereto at the outer tube distal end; a flow controller, the flow controller including a flow controller body defining a body proximal end and an opposed body distal end, the flow controller body being securable to the outer tube in the flow controller receiving section, the body distal end being closer to the outer tube distal end than the body proximal end when the flow controller body is secured to the outer tube in an operational configuration; and a drilling accessory insertable in the outer tube and through the flow controller. The flow controller is movable between an open configuration and a closed configuration, wherein, when the flow controller body is secured to the outer tube in the operational configuration, in the open configuration, the flow controller allows passage of the drilling accessory therethrough, and in the closed configuration, the flow controller hinders flow of the fluid therethrough towards the borehole proximal end when the flow controller is located closer to the borehole proximal end than the fluid.

In some embodiments of the invention, the flow controller is configured for automatically moving from the open configuration to the closed configuration when the fluid moves through the flow controller towards the borehole proximal end and the drilling accessory is withdrawn from the flow controller.

In some embodiments of the invention, the flow controller is configured for automatically moving from the closed configuration to the open configuration when the drilling accessory is moved therethrough in a direction leading from the body proximal end towards the body distal end.

In a variant, the flow controller further includes at least two pivoting members, the pivoting members being each pivotally mounted to the flow controller body so as to be movable between an extended position and a retracted position, the pivoting members being in the extended position when the flow controller is in the closed configuration and the pivoting members being in the retracted position when flow controller is in the open configuration.

In some embodiments of the invention, the pivoting members are substantially parallel to the outer tube.

In some embodiments of the invention, the flow controller body defines a body passageway extending longitudinally therethrough, the pivoting members extending across the body passageway in the extended position and the pivoting members being retracted from the body passageway in the retracted position.

In some embodiments of the invention, defines a tapered section located closer to the body proximal end than the pivoting members, the tapered section tapering in a direction leading towards the body distal end. Also, the body passageway defines a substantially cylindrical section located closer to the body distal end than the tapered section.

In some embodiments of the invention, in the extended position, the pivoting members together form a substantially conical structure tapering in a direction leading from the body proximal end towards the body distal end.

In some embodiments of the invention, the pivoting members define each a mounting portion and a flow obstructing portion extending therefrom, the mounting portions being pivotally mounted to the flow controller body. For example, the flow obstructing portion is substantially triangular.

In some embodiments of the invention, the flow obstructing portion defines a flow obstructing portion inner surface and an opposed flow obstructing portion outer surface, the flow obstructing portion outer surface facing the outer tube distal end when the flow controller is mounted to the outer tube in the operational configuration and the flow controller is in the closed configuration, the flow obstructing portion outer surface defining a groove extending therealong. For example, the groove is substantially V-shaped and oriented so as to point towards the body proximal end.

In some embodiments of the invention, the flow obstructing portions of all of the pivoting members mate together in the closed configuration so as to define elongated channels at their junctions.

In some embodiments of the invention, the flow controller body is substantially annular and defines at least two substantially circumferentially extending mounting recesses extending thereinto from the body distal end, the mounting recesses each receiving at least part of one of the mounting portions thereinto. For example, the mounting portions each define a mounting aperture extending thereacross, the flow controller further comprising at least two mounting pins each extending across a respective one of the mounting recesses substantially circumferentially relative to the flow controller body, each of the mounting pins also extending through a respective one of the mounting apertures so that each of the mounting portions is pivotable relative to the flow controller body. In a specific example, the mounting pins are selectively removable from the flow controller body to allow removal of the pivoting members therefrom. In some embodiments of the invention, the mounting portions each define an outer tube engaging portion, the outer tube engaging portion engaging the outer tube when the flow controller is mounted to the outer tube in an operational configuration and the flow controller is in the closed configuration. For example, the outer tube engaging portion defines a notch for receiving part of the outer tube thereinto.

In some embodiments of the invention, the flow obstructing portions are located distally relative to the body distal end.

In some embodiments of the invention, the at least two pivoting members consist of six pivoting members.

In some embodiments of the invention, the at least two pivoting members are freely pivotable between the extended and retracted positions.

In some embodiments of the invention, the outer tube defines an outer tube passageway extending therethrough and a substantially annular recess extending substantially radially outwardly in the outer tube from the outer tube passageway in the flow controller receiving section, the flow controller body defining a substantially annular ridge extending substantially radially outwardly therefrom and insertable in the recess.

In some embodiments of the invention, the recess and the ridge have substantially complementary shapes and dimensions so that the ridge is substantially snugly receivable in the recess.

In a variant, the drilling accessory includes a sample retrieving accessory for retrieving a sample from the borehole. For example, the sample retrieving accessory includes a core barrel assembly.

In another variant, the drilling accessory includes an instrument for acquiring data characterizing the subterranean formation or the borehole.

In some embodiments of the invention, the flow controller includes a section having a configuration and dimensions similar to those of the drilling accessory so that when the drilling accessory extends through the flow controller with the flow controller in the open configuration, the drilling accessory inhibits passage of the fluid therethrough.

In another broad aspect, the invention provides a flow controller usable with an outer tube and a drilling accessory, the outer tube defining an outer tube distal end and a flow controller receiving section spaced apart from the outer tube distal end, the outer tube being configured for attaching a drill bit thereto at the outer tube distal end, the flow controller being usable in a subterranean formation containing a fluid, the flow controller comprising: a flow controller body defining a body proximal end and an opposed body distal end, the flow controller body being securable to the outer tube in the flow controller receiving section, the body distal end being closer to the outer tube distal end than the body proximal end when the flow controller body is secured to the outer tube in an operational configuration; the flow controller being movable between an open configuration and a closed configuration, wherein, when the flow controller body is secured to the outer tube in the operational configuration, in the open configuration, the flow controller allows passage of the drilling accessory therethrough, and in the closed configuration, the flow controller hinders flow of the fluid therethrough towards the borehole proximal end when the flow controller is located closer to the borehole proximal end than the fluid.

All the various features of the flow controller part of the system described hereinabove are applicable to the flow controller of this aspect of the invention.

In yet another broad aspect, the invention provides a method for retrieving a sample using a sample retrieving accessory from a borehole in a subterranean formation containing fluids, the borehole defining a borehole proximal end and an opposed borehole distal end, the borehole being drilled using a drill bit secured at a tube distal end of an outer tube, the method using a flow controller movable between an open configuration and a closed configuration, the flow controller being mounted in the outer tube, the method comprising: inserting the outer tube in the borehole such that the flow controller is located closer to the borehole proximal end than the fluid; inserting the sample retrieving accessory in the outer tube and through the flow controller, the flow controller achieving the open configuration when the sample retrieving accessory is inserted therethrough; collecting the sample using the sample retrieving accessory; withdrawing the sample retrieving accessory from the borehole; moving the flow controller to the closed configuration when the sample retrieving accessory is withdrawn at a location closer to the borehole proximal end than the flow controller, wherein in the closed configuration the flow controller inhibits flow therethrough of the fluid located distally relative thereto.

In some embodiments of the invention, the flow controller automatically moves to the closed configuration through the action of the fluid when the fluid flows therethrough.

In some embodiments of the invention, part of the sample retrieving accessory remains in the flow controller while the sample is collected to maintain the flow controller in the open configuration.

For example, the system and flow controller described hereinabove are usable to perform the method Advantageously, the proposed system provides a relatively easy, inexpensive and safe manner of reducing overflow of fluids from boreholes while allowing access to the distal parts of the borehole. Also, the proposed system greatly reduces risks that a high pressure fluid flow would forcefully push out of the borehole the drilling accessory, which could present great danger to drilling personnel. In addition, when the drilling accessory is lowered in a borehole using a wireline, such forceful expulsion from the borehole could cause problems with the wireline, such as knotting. These problems are therefore avoided, or at least greatly reduced, with the proposed system.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
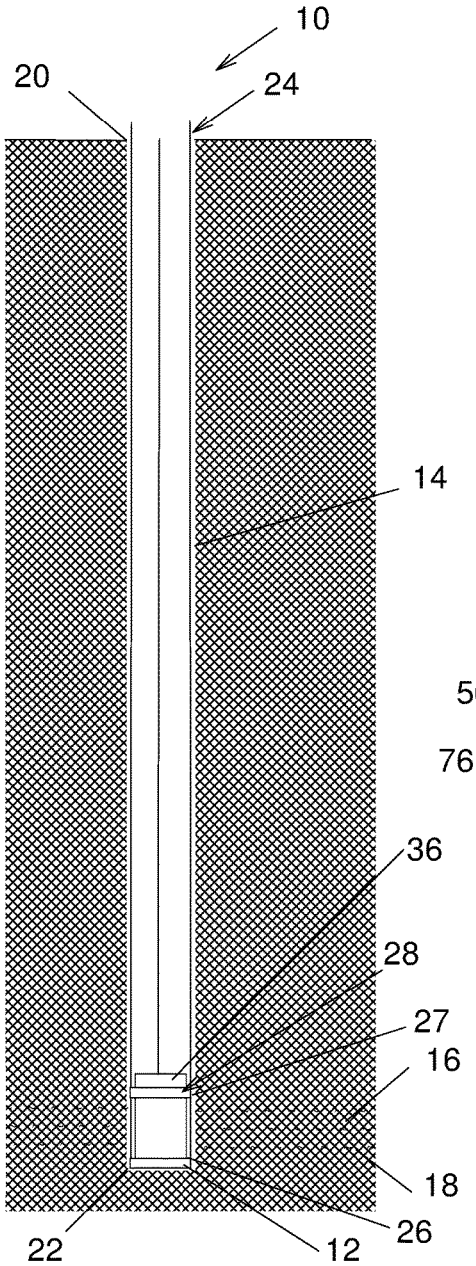
FIG. 1, in a schematic view, illustrates and system in accordance with an embodiment of the present invention, the system being used for drilling a borehole in a subterranean formation containing a fluid.

Referring to FIG. 1, there is shown a schematic view of a system 10 in accordance with an embodiment of the present invention, the system 10 being usable with a drill bit 12 for drilling a borehole 14 in a subterranean formation 16 containing a fluid 18. The borehole 14 defines a borehole proximal end 20 and an opposed borehole distal end 22. The system 10 includes an outer tube 24, a flow controller 28 and a drilling accessory 36. The system 10 is typically used with machinery (not shown in the drawings) to handle the outer tube 24 and to rotate the outer tube 24 while drilling.

The outer tube 24 defines an outer tube distal end 26 and a flow controller receiving section 27 spaced apart from the outer tube distal end 26. The outer tube 24 is configured for attaching the drill bit 12 to the outer tube distal end 26 in a conventional manner. For the purpose of this document, the terminology proximal and distal refers to a distance from an operator (not shown in the drawings) outside of the borehole 14 who operates the system 10 to drill the borehole 14. Distal elements are provided further away from the operator than proximal elements. This terminology is used to facilitate the description of the system 10 and should not be used to restrict the scope of the present invention. Also, the terminology "substantially" in this document is used to denote variations in the thus qualified terms that have no significant effect on the principle of operation of the system 10. These variations may be minor variations in design or variations due to mechanical tolerances in manufacturing and use of the system 10. These variations are to be seen with the eye of the reader skilled in the art.

The drilling accessory 36 is insertable in the outer tube 24 and through the flow controller 28. An example of a drilling accessory 36 includes a sample retrieving accessory for retrieving a sample from the borehole 14. For example, such a sample retrieving accessory can include a core barrel assembly. In another example, the drilling accessory 36 includes an instrument for acquiring data characterizing the subterranean formation 16 or the borehole 14. These examples of drilling accessories 36 should not be construed as limiting and any other suitable drilling accessories 36 are usable.

Figure 2:
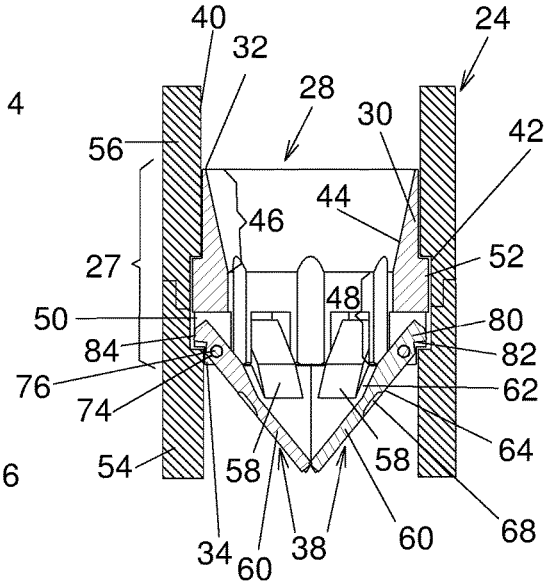
FIG. 2, in a partial side cross-sectional view, illustrates the system shown in FIG. 1.

Referring for example to FIG. 2, the flow controller 28 includes a flow controller body 30 defining a body proximal end 32 and an opposed body distal end 34. The flow controller body 30 is securable to the outer tube 24 in the flow controller receiving section 27. The body distal end 34 is closer to the outer tube distal end 26 (not seen in FIG. 2) than the body proximal end 32 when the flow controller body 30 is secured to the outer tube 24 in an operational configuration, such as seen in FIG. 1.

The flow controller 28 is movable between an open configuration (seen in FIGS. 3, 5 and 7) and a closed configuration (seen in FIGS. 2, 4, 6 and 8). When the flow controller body 30 is secured to the outer tube 24 in the operational configuration, in the open configuration, the flow controller 28 allows passage of the drilling accessory 36 therethrough. In the closed configuration, the flow controller 28 hinders flow of the fluid 18 therethrough towards the borehole proximal end 20 when the flow controller 28 is located closer to the borehole proximal end 20 than the fluid 18. It should be noted that in some embodiments, the flow controller 28 only reduces the flow of the fluid 18 in the closed configuration as compared to the open configuration. For example, and non-limitingly, the flow controller 28 reduces the flow of fluid by a factor of 5 or a factor of 10 when moving from the open configuration to the closed configuration. However, in some embodiments, the flow controller 28 is substantially fluid proof in the closed configuration and completely, or almost completely, reduces the flow of fluid 18 in the closed configuration.

Referring to FIG. 2, the outer tube 24 is similar to a conventional outer tube 24 used in drilling operations and defines an outer tube passageway 40 extending therethrough. The outer tube 24 is typically made out of many pipes screwed to each other and is used to rotate the drill bit 12 to drill the borehole 14. However, in opposition to conventional outer tubes which are typically of constant diameter along their whole length, the outer tube 24 defines a substantially annular recess 42 extending substantially radially outwardly thereinto from the outer tube passageway 40 in the flow controller receiving section 27. The recess 42 is used to receive part of the flow controller 28 as described in further details hereinbelow.

Typically, the flow controller 28 is configured for automatically moving from the open configuration to the closed configuration when the fluid 18 moves therethrough towards the borehole proximal end 20 and the drilling accessory 36 is withdrawn from the flow controller 28. Also typically, the flow controller 28 is configured for automatically moving from the closed configuration to the open configuration when the drilling accessory 36 is moved therethrough in a direction leading from the body proximal end 32 towards the body distal end 34. A non-limiting example of a flow controller 28 that can achieve these operational characteristics is described hereinbelow. However, in alternative embodiments of the invention, the drilling accessory 36 and the flow controller 28 are configured such that the drilling accessory 36 moves the flow controller 28 to the closed configuration when the drilling accessory 36 is withdraw from the flow controller 28.

Figure 5:
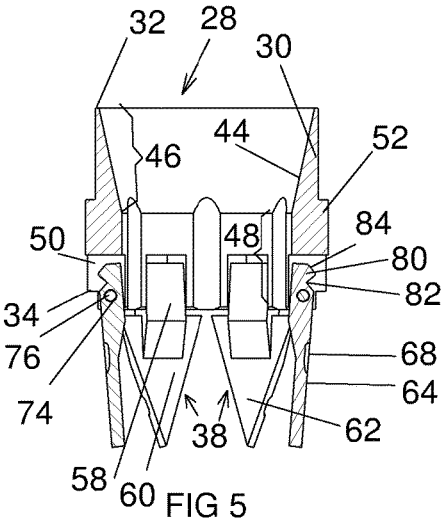
FIG. 5, in a front cross-sectional view along section line V-V of FIG. 3, illustrates the flow controller shown in FIGS. 3 and 4, the flow controller being shown in the open configuration.
Figure 6:
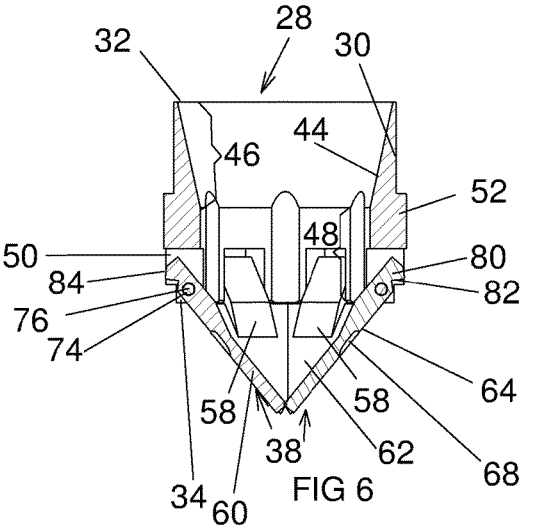
FIG. 6, in a front cross-sectional view along section line VI-VI of FIG. 4, illustrates the flow controller shown in FIGS. 3 to 5, the flow controller being shown in the closed configuration.
Figure 7:
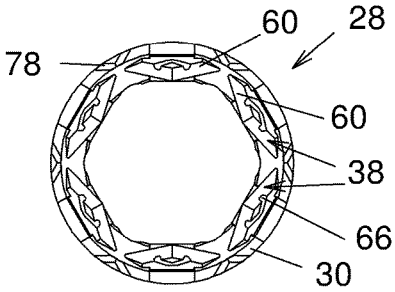
FIG. 7, in a bottom plan view, illustrates the flow controller shown in FIGS. 3 to 6, the flow controller being shown in the open configuration.

Referring for example to FIGS. 5 and 6, the flow controller body 30 defines a body passageway 44 extending longitudinally therethrough. In addition to the flow controller body 30, the flow controller 28 further includes at least two pivoting members 38, the pivoting members 38 being each pivotally mounted to the flow controller body 30 so as to be movable between an extended position and a retracted position. The pivoting members 38 are in the extended position when the flow controller 28 is in the closed configuration and the pivoting members 38 are in the retracted position when flow controller 28 is in the open configuration. Any suitable number of pivoting members 38 can be used, but a flow controller 28 including six pivoting members 38 is well suited for many typical drilling operations.

The pivoting members 38 extend across the body passageway 44 in the extended position and the pivoting members 38 are retracted from the body passageway 44 in the retracted position. Typically, in the retracted position, the pivoting members 38 are substantially parallel to the outer tube 24 and in the extended position, the pivoting members 38 together form a substantially conical structure tapering in a direction leading from the body proximal end 32 towards the body distal end 34. Typically, but not necessarily, the pivoting members 38 are freely pivotable between the extended and retracted positions, in other words, there is no element biasing the pivoting members 38 towards any of the extended and retracted positions. However, in alternative embodiments of the invention not shown in the drawings, springs or other suitable biasing elements may bias the pivoting members 38 towards one of the extended and retracted positions.

Referring for example to FIG. 5, the body passageway 44 defines a tapered section 46 located closer to the body proximal end 32 than the pivoting members 38. Typically, the tapered section 46 extends from the body proximal end 32. The tapered section 46 tapers in a direction leading towards the body distal end 34 and guides the drilling accessory 36 as the drilling accessory enters the body passageway 44. For example, the tapered section 46 is substantially frusto-conical. The body passageway 44 also defines a substantially cylindrical section 48 located closer to the body distal end 34 than the tapered section 46. Typically, the cylindrical section 48 extends from the tapered section 46 and reaches the body distal end 34. Typically, the cylindrical section 48 and the drilling accessory 36 have substantially similar transversal cross-sectional configurations and dimensions so that the drilling accessory 36 is substantially tightly fitted in the cylindrical section 48. This tight fit prevents a large flow of the fluid 18 through the flow controller 28 when the drilling accessory 36 is inserted therethrough.

The flow controller body 30 is substantially annular and defines at least two substantially circumferentially extending mounting recesses 50 extending thereinto from the body distal end 34, one for each pivoting member 38. Also, the flow controller body 30 defines a substantially annular ridge 52 extending substantially radially outwardly therefrom and insertable in the recess 42 of the outer tube 24. Typically, the recess 42 and the ridge 52 have substantially complementary shapes and dimensions so that the ridge 52 is substantially snugly receivable in the recess 42. In some embodiments of the invention, as seen in FIG. 2, the outer tube 24 can be separated into two outer tube sections 54 and 56 removably attachable to each other, for example using threads (not shown in the drawings), and each defining part of the recess 42. This allows easy assembly of the flow controller 28 and outer tube 24 in a rigid and sturdy configuration.

Figure 4:
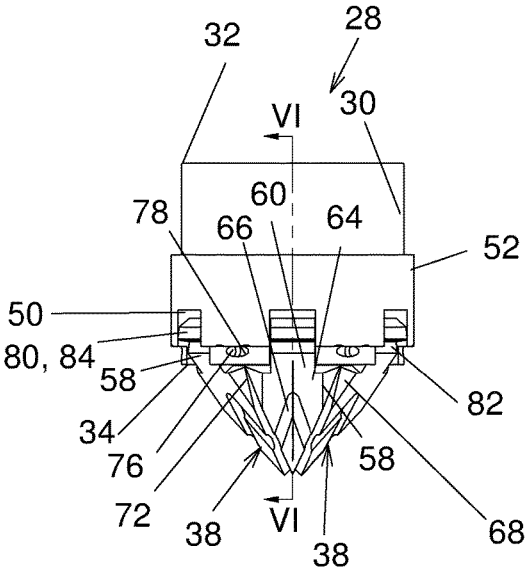
FIG. 4, in a side elevation view, illustrates the flow controller shown in FIG. 3, the flow controller being shown in a closed configuration.

Referring for example to FIGS. 5 and 6, in some embodiments of the invention the pivoting members 38 define each a mounting portion 58, which is for example substantially elongated, and a flow obstructing portion 60 extending therefrom. The mounting portions 58 is pivotally mounted to the flow controller body 30. The flow obstructing portions 60 typically abut against each other in the closed configuration, as seen in FIGS. 4, 6 and 8.

Returning to FIGS. 5 and 6, in some embodiments of the invention, the flow obstructing portion 60 is substantially triangular. The flow obstructing portion 60 may be substantially flat, or may include a slight curve so as to better approximate a cone when abutting against each other in the closed configuration.

The flow obstructing portions 60 each define a flow obstructing portion inner surface 62 and an opposed flow obstructing portion outer surface 64. The flow obstructing portion outer surface 64 faces the outer tube distal end 26 when the flow controller 28 is mounted to the outer tube 24 in an operational configuration and the flow controller 28 is in the closed configuration. As better seen in FIGS. 3, 4 and 8, in some embodiments of the invention, the flow obstructing portion outer surface 64 defines a groove 66 extending therealong. For example, the groove 66 is substantially V-shaped, oriented so as to point towards the body proximal end 32, and entirely located distally relative to the location on the pivoting member 38 about which the pivoting member 38 pivots. The groove 66 helps configuration of the flow controller 28 from the open configuration to the closed configuration when the fluid 18 moves through the flow controller 28 by creating a moment of force on the pivoting member 38. In some embodiments of the invention, as better seen in FIG. 3, the flow obstructing portion 60 also defines beveled edge portions 68 adjacent the mounting portions 58 for the same purpose.

Figure 8:
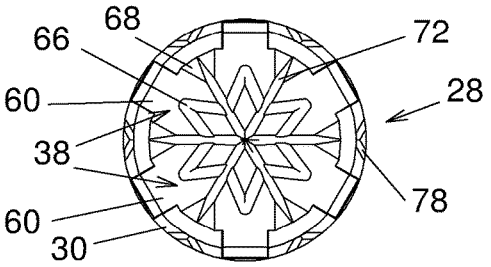
FIG. 8, in a bottom plan view, illustrates the flow controller shown in FIGS. 3 to 7, the flow controller being shown in the closed configuration.

In some embodiments of the invention, the flow obstructing portions 60 of all of the pivoting members 38 mate together in the closed configuration so as to define elongated channels 72 at their junctions, as better seen in FIG. 8. The channels 72 help in maintaining the flow controller 28 in the closed configuration 28 under pressure from the fluid 28. Also, in some embodiments of the invention, the flow obstructing portions 60 are outside of the flow controller body 30, distal relative to the body distal end 34. Also, typically, the flow obstructing portions 60 are substantially adjacent to the body distal end 34 in the closed configuration.

Referring now to FIG. 5, the mounting portions 58 each define a mounting aperture 74 extending thereacross. The mounting recesses 50 each receive at least part of one of the mounting portions 58 thereinto, more specifically part of the mounting portions 58 including the mounting aperture 74. A mounting pin 76 extends across each of the mounting recesses 50 substantially circumferentially relative to the flow controller body 30. Each of the mounting pins 76 also extends through a respective one of the mounting apertures 74 so that each of the mounting portions 58 is pivotable relative to the flow controller body 30.

Figure 3:
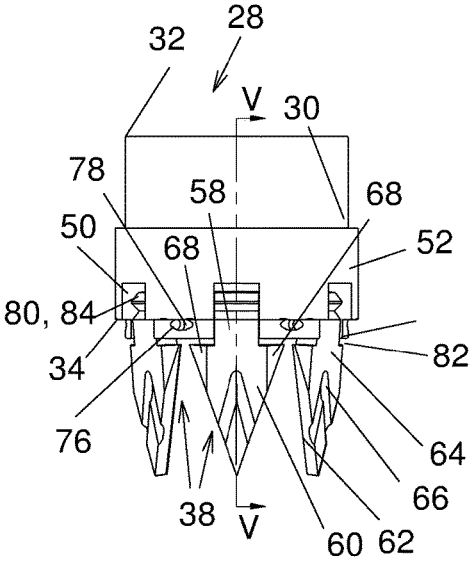
FIG. 3, in a side elevation view, illustrates a flow controller part of the system shown in FIGS. 1 and 2, the flow controller being shown in an open configuration.

In some embodiments of the invention, the mounting pins 76 are selectively removable from the flow controller body 30 to allow removal of the pivoting members 38 therefrom. To that effect, as seen in FIGS. 3 and 4, pin access apertures 78 extend through the flow controller body 30 to axially reach the mounting pins 76. For example, the mounting pins 76 are press-fitted to one of the pin access apertures 78 or the mounting apertures 74 and freely pivotable relative to the other one of the pin access apertures 78 and the mounting apertures 74. However, in alternative embodiments of the invention, the mounting portions 58 are pivotally mounted to the flow controller body 30 in any other suitable manner.

In some embodiments of the invention, the mounting portions 58 each define an outer tube engaging portion 80. The outer tube engaging portion 80 is provided opposed to the flow obstructing portions 60 and engages the outer tube 24 when the flow controller 28 is mounted to the outer tube 24 in an operational configuration and the flow controller 28 is in the closed configuration, as seen in FIG. 2. The outer tube engaging portion 80 prevents over rotation of the pivoting members 38 in the extended position as the pivoting members 38 have to resist the pressure exerted by the fluid 18. To that effect, the outer tube engaging portion 80 may for example define a notch 82 for receiving part of the outer tube 24 thereinto, for example for receiving the part of the outer tube 24 just distal to the recess 42. In addition, the outer tube engaging portion 80 may define an abutment surface 84 adjacent the notch 80 for abutting against the outer tube 24 in the extended position.

The flow controller 28 may be manufactured using any suitable material capable of withstanding the environment in which the system 10 operates, such as, for example and non-limitingly, stainless steel.

In use, the flow controller 28 allows drilling personnel to perform a method for retrieving a sample (not shown in the drawings) using the drilling accessory 36 in the form of a sample retrieving accessory from a borehole 14 in a subterranean formation 16 containing fluid 18.

First, the flow controller 28 is mounted in the outer tube 24. The flow controller 28 may be used for most of the drilling operation, or the flow controller 28 may be used when previous surveys or other indications (such a rise in the amount of fluid contained in the borehole 14) indicates that the subterranean formation 16 including the fluid 18 will be reached soon. The outer tube 24 is inserted in the borehole 14 such that the flow controller 28 is located closer to the borehole proximal end 20 than the fluid 18. Drilling can then continue until the fluid 18 containing subterranean formation 16 is reached.

When the fluid 18 is reached, the flow controller 28 rapidly assumes the closed configuration, which prevents a large outflow of the fluid 18. A small quantity of fluid 18 may be allowed to leak in some embodiments as such small quantities of fluids 18 are easily managed and will be under less pressure than the fluid 18 distal to the flow controller 28 due to the restriction to fluid 18 flow provided by the flow controller 28.

When the drilling personnel wishes to retrieve a sample from the borehole 14, the sample retrieving accessory is inserted in the outer tube 24 and through the flow controller 28. The flow controller 28 achieves the open configuration when the sample retrieving accessory is inserted therethrough. In some embodiments, the open configuration is achieved due to the weight of the sample retrieving accessory as the sample retrieving accessory is lowered through the flow controller 28. In other embodiments, the sample retrieving accessory is pushed through the flow controller 28 to achieve the open configuration. Typically, part of the sample retrieving accessory remains in the flow controller 28 while the sample is collected to maintain the flow controller 28 in the open configuration to minimize fluid 18 flow therethrough.

Then, the sample is collected in a conventional manner using the sample retrieving accessory. For example, if the sample retrieving accessory is a core barrel assembly, drilling continues while a core is retrieved by the core barrel assembly.

Afterward, the sample retrieving accessory is withdrawn from the borehole 14 and the flow controller 28 is moved to the closed configuration when the sample retrieving accessory is withdrawn to a location closer to the borehole proximal end 20 than the flow controller 28. Typically, the flow controller 28 automatically moves to the closed configuration through the action of the fluid 18 when the fluid 18 flows therethrough.

Once all sample retrieving operations from the region containing the fluid 18 have been completed, conventional manners of fluid proofing the borehole 14 may be applied so that the flow controller 28 is no longer required.

As mentioned hereinabove, other operations, such as borehole surveying or subterranean formation characterizing may also be performed in a similar manner using the flow controller 28 and a suitable drilling accessory 36.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can therefore be modified without departing from the spirit and nature of the subject invention as defined in the appended claims.

What is claimed is:

1. A system usable with a drill bit for drilling a borehole in a subterranean formation containing a fluid, said borehole defining a borehole proximal end and an opposed borehole distal end, said system comprising:

an outer tube, said outer tube defining an outer tube distal end and a flow controller receiving section spaced apart from said outer tube distal end, said outer tube being configured for attaching said drill bit thereto at said outer tube distal end;

a flow controller, said flow controller including a flow controller body defining a body proximal end and an opposed body distal end, said flow controller body being securable to said outer tube in said flow controller receiving section, said body distal end being closer to said outer tube distal end than said body proximal end when said flow controller body is secured to said outer tube in an operational configuration; and a drilling accessory insertable in said outer tube and through said flow controller;

said flow controller being movable between an open configuration and a closed configuration, wherein, when said flow controller body is secured to said outer tube in said operational configuration, in said open configuration, said flow controller allows passage of said drilling accessory therethrough, and in said closed configuration, said flow controller hinders flow of said fluid therethrough towards said borehole proximal end when said flow controller is located closer to said borehole proximal end than said fluid;

wherein said flow controller includes a section having a configuration and dimensions similar to those of said drilling accessory so that when said drilling accessory extends through said flow controller with said flow controller in said open configuration, said drilling accessory inhibits passage of said fluid therethrough.

2. A system as defined in claim 1, wherein said flow controller is configured for automatically moving from said open configuration to said closed configuration when said fluid moves through said flow controller towards said borehole proximal end and said drilling accessory is withdrawn from said flow controller.

3. A system as defined in claim 1, wherein said flow controller is configured for automatically moving from said closed configuration to said open configuration when said drilling accessory is moved therethrough in a direction leading from said body proximal end towards said body distal end.

4. A system as defined in claim 1, wherein said flow controller further includes at least two pivoting members, said pivoting members being each pivotally mounted to said flow controller body so as to be movable between an extended position and a retracted position, said pivoting members being in said extended position when said flow controller is in said closed configuration and said pivoting members being in said retracted position when flow controller is in said open configuration.

5. A system as defined in claim 4, wherein in said retracted position, said pivoting members are substantially parallel to said outer tube.

6. A system as defined in claim 4, wherein said flow controller body defines a body passageway extending longitudinally therethrough, said pivoting members extending across said body passageway in said extended position and said pivoting members being retracted from said body passageway in said retracted position.

7. A system as defined in claim 6, wherein said body passageway defines a tapered section located closer to said body proximal end than said pivoting members, said tapered section tapering in a direction leading towards said body distal end.

8. A system as defined in claim 7, wherein said body passageway defines a substantially cylindrical section located closer to said body distal end than said tapered section.

9. A system as defined in claim 4, wherein in said extended position, said pivoting members together form a substantially conical structure tapering in a direction leading from said body proximal end towards said body distal end.

10. A system as defined in claim 4, wherein said pivoting members define each a mounting portion and a flow obstructing portion extending therefrom, said mounting portions being pivotally mounted to said flow controller body.

11. A system as defined in claim 10, wherein said flow obstructing portion is substantially triangular.

12. A system as defined in claim 10, wherein said flow obstructing portion defines a flow obstructing portion inner surface and an opposed flow obstructing portion outer surface, said flow obstructing portion outer surface facing said outer tube distal end when said flow controller is mounted to said outer tube in said operational configuration and said flow controller is in said closed configuration, said flow obstructing portion outer surface defining a groove extending therealong.

13. A system as defined in claim 12, wherein said groove is substantially V-shaped and oriented so as to point towards said body proximal end.

14. A system as defined in claim 10, wherein said flow obstructing portions of all of said pivoting members mate together in said closed configuration so as to define elongated channels at their junctions.

15. A system as defined in claim 10, wherein said flow controller body is substantially annular and defines at least two substantially circumferentially extending mounting recesses extending thereinto from said body distal end, said mounting recesses each receiving at least part of one of said mounting portions thereinto.

16. A system as defined in claim 15, wherein said mounting portions each define a mounting aperture extending thereacross, said flow controller further comprising at least two mounting pins each extending across a respective one of said mounting recesses substantially circumferentially relative to said flow controller body, each of said mounting pins also extending through a respective one of said mounting apertures so that each of said mounting portions is pivotable relative to said flow controller body.

17. A system as defined in claim 16, wherein said mounting pins are selectively removable from said flow controller body to allow removal of said pivoting members therefrom.

18. A system as defined in claim 16, wherein said mounting portions each define an outer tube engaging portion, said outer tube engaging portion engaging said outer tube when said flow controller is mounted to said outer tube in an operational configuration and said flow controller is in said closed configuration.

19. A system as defined in claim 18, wherein said outer tube engaging portion defines a notch for receiving part of said outer tube thereinto.

20. A system as defined in claim 10, wherein said flow obstructing portions are located distally relative to said body distal end.

21. A system as defined in claim 4, wherein said at least two pivoting members consist of six pivoting members.

22. A system as defined in claim 4, wherein said at least two pivoting members are freely pivotable between said extended and retracted positions.

23. A system as defined in claim 1, wherein said outer tube defines an outer tube passageway extending therethrough and a substantially annular recess extending substantially radially outwardly in said outer tube from said outer tube passageway in said flow controller receiving section, said flow controller body defining a substantially annular ridge extending substantially radially outwardly therefrom and insertable in said recess.

24. A system as defined in claim 23, wherein said recess and said ridge have substantially complementary shapes and dimensions so that said ridge is substantially snugly receivable in said recess.

25. A system as defined in claim 1, wherein said drilling accessory includes a sample retrieving accessory for retrieving a sample from said borehole.

26. A system as defined in claim 25, wherein said sample retrieving accessory includes a core barrel assembly.

27. A system as defined in claim 1, wherein said drilling accessory includes an instrument for acquiring data characterizing said subterranean formation or said borehole.

28. A system usable with a drill bit for drilling a borehole in a subterranean formation containing a fluid, said borehole defining a borehole proximal end and an opposed borehole distal end, said system comprising:

an outer tube, said outer tube defining an outer tube distal end and a flow controller receiving section spaced apart from said outer tube distal end, said outer tube being configured for attaching said drill bit thereto at said outer tube distal end;

a flow controller, said flow controller including a flow controller body defining a body proximal end and an opposed body distal end, said flow controller body being securable to said outer tube in said flow controller receiving section, said body distal end being closer to said outer tube distal end than said body proximal end when said flow controller body is secured to said outer tube in an operational configuration; and a drilling accessory insertable in said outer tube and through said flow controller;

said flow controller being movable between an open configuration and a closed configuration, wherein, when said flow controller body is secured to said outer tube in said operational configuration, in said open configuration, said flow controller allows passage of said drilling accessory therethrough, and in said closed configuration, said flow controller hinders flow of said fluid therethrough towards said borehole proximal end when said flow controller is located closer to said borehole proximal end than said fluid;

wherein said flow controller further includes at least two pivoting members, said pivoting members being each pivotally mounted to said flow controller body so as to be movable between an extended position and a retracted position, said pivoting members being in said extended position when said flow controller is in said closed configuration and said pivoting members being in said retracted position when flow controller is in said open configuration;

said flow controller body defines a body passageway extending longitudinally therethrough, said pivoting members extending across said body passageway in said extended position and said pivoting members being retracted from said body passageway in said retracted position; and said body passageway defines a tapered section located closer to said body proximal end than said pivoting members, said tapered section tapering in a direction leading towards said body distal end.

29. The system as defined in claim 28, wherein said body passageway defines a substantially cylindrical section located closer to said body distal end than said tapered section.

30. A system usable with a drill bit for drilling a borehole in a subterranean formation containing a fluid, said borehole defining a borehole proximal end and an opposed borehole distal end, said system comprising:

an outer tube, said outer tube defining an outer tube distal end and a flow controller receiving section spaced apart from said outer tube distal end, said outer tube being configured for attaching said drill bit thereto at said outer tube distal end;

a flow controller, said flow controller including a flow controller body defining a body proximal end and an opposed body distal end, said flow controller body being securable to said outer tube in said flow controller receiving section, said body distal end being closer to said outer tube distal end than said body proximal end when said flow controller body is secured to said outer tube in an operational configuration; and a drilling accessory insertable in said outer tube and through said flow controller;

said flow controller being movable between an open configuration and a closed configuration, wherein, when said flow controller body is secured to said outer tube in said operational configuration, in said open configuration, said flow controller allows passage of said drilling accessory therethrough, and in said closed configuration, said flow controller hinders flow of said fluid therethrough towards said borehole proximal end when said flow controller is located closer to said borehole proximal end than said fluid;

wherein said flow controller further includes at least two pivoting members, said pivoting members being each pivotally mounted to said flow controller body so as to be movable between an extended position and a retracted position, said pivoting members being in said extended position when said flow controller is in said closed configuration and said pivoting members being in said retracted position when flow controller is in said open configuration, said pivoting members defining each a mounting portion and a flow obstructing portion extending therefrom, said mounting portions being pivotally mounted to said flow controller body, said flow obstructing portion defining a flow obstructing portion inner surface and an opposed flow obstructing portion outer surface, said flow obstructing portion outer surface facing said outer tube distal end when said flow controller is mounted to said outer tube in said operational configuration and said flow controller is in said closed configuration, said flow obstructing portion outer surface defining a groove extending therealong, said groove being substantially V-shaped and oriented so as to point towards said body proximal end.

31. A system usable with a drill bit for drilling a borehole in a subterranean formation containing a fluid, said borehole defining a borehole proximal end and an opposed borehole distal end, said system comprising:

an outer tube, said outer tube defining an outer tube distal end and a flow controller receiving section spaced apart from said outer tube distal end, said outer tube being configured for attaching said drill bit thereto at said outer tube distal end;

a flow controller, said flow controller including a flow controller body defining a body proximal end and an opposed body distal end, said flow controller body being securable to said outer tube in said flow controller receiving section, said body distal end being closer to said outer tube distal end than said body proximal end when said flow controller body is secured to said outer tube in an operational configuration; and a drilling accessory insertable in said outer tube and through said flow controller;

said flow controller being movable between an open configuration and a closed configuration, wherein, when said flow controller body is secured to said outer tube in said operational configuration, in said open configuration, said flow controller allows passage of said drilling accessory therethrough, and in said closed configuration, said flow controller hinders flow of said fluid therethrough towards said borehole proximal end when said flow controller is located closer to said borehole proximal end than said fluid;

wherein said flow controller further includes at least two pivoting members, said pivoting members being each pivotally mounted to said flow controller body so as to be movable between an extended position and a retracted position, said pivoting members being in said extended position when said flow controller is in said closed configuration and said pivoting members being in said retracted position when flow controller is in said open configuration;

said pivoting members define each a mounting portion and a flow obstructing portion extending therefrom, said mounting portions being pivotally mounted to said flow controller body;

said flow controller body is substantially annular and defines at least two substantially circumferentially extending mounting recesses extending thereinto from said body distal end, said mounting recesses each receiving at least part of one of said mounting portions thereinto;

said mounting portions each define a mounting aperture extending thereacross, said flow controller further comprising at least two mounting pins each extending across a respective one of said mounting recesses substantially circumferentially relative to said flow controller body, each of said mounting pins also extending through a respective one of said mounting apertures so that each of said mounting portions is pivotable relative to said flow controller body;

said mounting portions each define an outer tube engaging portion, said outer tube engaging portion engaging said outer tube when said flow controller is mounted to said outer tube in an operational configuration and said flow controller is in said closed configuration and;

said outer tube engaging portion defines a notch for receiving part of said outer tube thereinto.

* * * * *